US011283148B2

(12) United States Patent
Kum et al.

(10) Patent No.: US 11,283,148 B2
(45) Date of Patent: Mar. 22, 2022

(54) ANTENNA ASSEMBLY COMPRISING LENS AND FILM LAYER

(71) Applicant: Samsung Electronics Co., Ltd., Suwon-si (KR)

(72) Inventors: Junsig Kum, Yongin-si (KR); Yoongeon Kim, Suwon-si (KR); Seungtae Ko, Suwon-si (KR); Hyunjin Kim, Seoul (KR); Youngju Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/631,008

(22) PCT Filed: Jul. 5, 2018

(86) PCT No.: PCT/KR2018/007629
§ 371 (c)(1),
(2) Date: Jan. 14, 2020

(87) PCT Pub. No.: WO2019/017628
PCT Pub. Date: Jan. 24, 2019

(65) Prior Publication Data

US 2020/0144692 A1 May 7, 2020

Related U.S. Application Data

(60) Provisional application No. 62/534,302, filed on Jul. 19, 2017.

(30) Foreign Application Priority Data

Dec. 19, 2017 (KR) ..... 10-2017-0175109

(51) Int. Cl.
*H01Q 1/00* (2006.01)
*H01Q 1/12* (2006.01)
(Continued)

(52) U.S. Cl.
CPC ..... *H01Q 1/007* (2013.01); *H01Q 1/12* (2013.01); *H01Q 1/40* (2013.01); *H01Q 19/09* (2013.01); *H01Q 21/22* (2013.01)

(58) Field of Classification Search
CPC ..... H01Q 1/007; H01Q 1/12; H01Q 1/40; H01Q 1/246; H01Q 19/09; H01Q 19/06;
(Continued)

(56) References Cited

U.S. PATENT DOCUMENTS 6,473,049 B2 10/2002 Takeuchi et al.
7,463,186 B1 12/2008 Cha
(Continued)

FOREIGN PATENT DOCUMENTS

CN 101403794 A 4/2009
EP 2 854 218 A1 4/2015
(Continued)

OTHER PUBLICATIONS

Extended European Search Report dated May 13, 2020, issued in European Patent Application No. 18835642.2.
(Continued)

*Primary Examiner* — Seokjin Kim
(74) *Attorney, Agent, or Firm* — Jefferson IP Law, LLP

(57) ABSTRACT

The present invention relates to a communication technique which fuses a 5G communication system with IoT technology to support higher data transmission rates after a 4G system, and system thereof. In addition, the present invention provides an antenna assembly which comprises: an antenna array which includes at least one antenna; a film layer which is made of at least one insulating material, spaced apart from the antenna array by a predetermined first distance and joined to one side of a window; and an
(Continued)

installation aid which has a surface fixed and attached to the window and the other surface on which an antenna array seating portion is formed.

20 Claims, 15 Drawing Sheets

(51) Int. Cl.
*H01Q 1/40* (2006.01)
*H01Q 19/09* (2006.01)
*H01Q 21/22* (2006.01)

(58) Field of Classification Search
CPC .. H01Q 121/22; H01Q 121/065; H01Q 15/02; H01Q 3/44; H01Q 3/46
See application file for complete search history.

(56) References Cited

U.S. PATENT DOCUMENTS

2002/0101390 A1* 8/2002 Takeuchi ..... H01Q 19/065 343/910
2003/0142018 A1 7/2003 Lange
2004/0234778 A1* 11/2004 Fukatani ..... B32B 17/10853 428/426
2007/0001918 A1 1/2007 Ebling et al.
2015/0087522 A1 3/2015 Kawaguchi et al.
2016/0231417 A1 8/2016 Aoki et al.
2018/0183152 A1* 6/2018 Turpin ..... H01Q 1/288
2018/0317097 A1* 11/2018 Senior ..... H04W 16/26

FOREIGN PATENT DOCUMENTS

JP 4-134909 A 5/1992
JP 2009-506585 A 2/2009
KR 20-2010-0001924 U 2/2010
KR 10-1319216 B1 10/2013
KR 10-2018-0042543 A 4/2018
WO 88/01440 A1 2/1988
WO WO8801440 A * 2/1988 ..... H01Q 1/422

OTHER PUBLICATIONS

O. Jeong et al., Broadband Plasma-Sprayed Anti-reflection Coating for Millimeter-Wave Astrophysics Experiments, Journal of Low Temperature Physics, Aug. 2016, vol. 184, Issue 3-4, pp. 621-626.
Chinese Office Action dated Jan. 6, 2021, issued in Chinese Patent Application No. 201880046852.0.

* cited by examiner

ANTENNA ASSEMBLY COMPRISING LENS AND FILM LAYER

TECHNICAL FIELD

The disclosure relates to an antenna assembly that is attached to a window and can improve radio wave transmission/reception performance.

BACKGROUND ART

In order to meet wireless data traffic demands that have increased after 4G communication system commercialization, efforts to develop an improved 5G communication system or a pre-5G communication system have been made. For this reason, the 5G communication system or the pre-5G communication system is called a beyond 4G network communication system or a post LTE system. In order to achieve a high data transmission rate, an implementation of the 5G communication system in a mmWave band (for example, 60 GHz band) is being considered. In the 5G communication system, technologies such as beamforming, massive MIMO, Full Dimensional MIMO (FD-MIMO), array antenna, analog beam-forming, and large scale antenna are being discussed as means to mitigate a propagation path loss in the mm Wave band and increase a propagation transmission distance. Further, the 5G communication system has developed technologies such as an evolved small cell, an advanced small cell, a cloud Radio Access Network (RAN), an ultra-dense network, Device to Device communication (D2D), a wireless backhaul, a moving network, cooperative communication, Coordinated Multi-Points (CoMP), and received interference cancellation to improve the system network. In addition, the 5G system has developed Advanced Coding Modulation (ACM) schemes such as Hybrid FSK and QAM Modulation (FQAM) and Sliding Window Superposition Coding (SWSC), and advanced access technologies such as Filter Bank Multi Carrier (FBMC), Non Orthogonal Multiple Access (NOMA), and Sparse Code Multiple Access (SCMA).

Meanwhile, the Internet has been evolved to an Internet of Things (IoT) network in which distributed components such as objects exchange and process information from a human-oriented connection network in which humans generate and consume information. An Internet of Everything (IoE) technology in which a big data processing technology through a connection with a cloud server or the like is combined with the IoT technology has emerged. In order to implement IoT, technical factors such as a sensing technique, wired/wireless communication, network infrastructure, service-interface technology, and security technology are required, and research on technologies such as a sensor network, Machine-to-Machine (M2M) communication, Machine-Type Communication (MTC), and the like for connection between objects has recently been conducted. In an IoT environment, through collection and analysis of data generated in connected objects, an intelligent Internet Technology (IT) service to create a new value for peoples' lives may be provided. The IoT may be applied to fields such as those of a smart home, a smart building, a smart city, a smart car, a connected car, a smart grid, health care, a smart home appliance, or high-tech medical services through the convergence of the conventional Information Technology (IT) and various industries.

Accordingly, various attempts to apply the 5G communication to the IoT network are made. For example, technologies such as a sensor network, Machine to Machine (M2M), and Machine Type Communication (MTC) are implemented by beamforming, MIMO, and array antenna schemes. The application of a cloud RAN as the big data processing technology may be an example of convergence of the 5G technology and the IoT technology.

DISCLOSURE OF INVENTION

Technical Problem

Since the radio wave band that 5G communication systems use is an extremely high frequency (mmWave) band, the coverage to which radio waves can be radiated is limited due to the characteristic of the extremely high frequency band having high linearity. Accordingly, array antennas are used to overcome this problem, but there is a limit in the gain of available radio waves.

Various embodiments of the disclosure provide an antenna assembly that can provide a wide coverage and a high gain in radio wave transmission/reception, particularly, provide the configuration of an antenna assembly when the antenna assembly is disposed around a window in a building.

Solution to Problem

An antenna assembly according to the disclosure may include: an antenna array including at least one antenna; a film layer made of at least one insulating substance, spaced a predetermined first distance apart from the antenna array, and bonded to a surface of a window; and an assistant installation structure having a first surface attached and fixed to the window and a second surface on which an antenna array seat is formed.

The antenna assembly may further include a lens spaced a predetermined second distance from the antenna array and disposed between the antenna array and the film layer, in which a seat for the lens may be formed on the second surface of the assistant installation structure.

The lens may be composed of a plurality of unit cells, and the unit cells may correct a phase of radio waves radiated from the antenna array in accordance with permittivity.

Permittivity of the insulating substance of the film layer may be lower than permittivity of the window and higher than permittivity of air, and the film layer may reduce a loss of transmission of radio waves through the window if the film layer is attached to the window.

The assistant installation structure may be attached and fixed to a sill of the window.

The assistant installation structure may be attached and fixed to a window frame of the window.

The antenna array may be fixed by being coupled to the assistant installation structure through the antenna array seat.

The antenna array seat may be formed so that the antenna array can be detachably attached to the assistant installation structure.

An antenna assembly according to the disclosure may include: an antenna array including at least one antenna; a film layer made of at least one insulating substance, spaced a predetermined first distance apart from the antenna array, and bonded to a surface of a window; and an assistant installation structure having a first surface coupled to the window and a second surface on which an antenna array seat is formed.

The antenna assembly may further include a lens spaced a predetermined second distance from the antenna array and disposed between the antenna array and the film layer, in which a seat for the lens may be formed on the second surface of the assistant installation structure.

The lens may be composed of a plurality of unit cells, and the unit cells correct a phase of radio waves radiated from the antenna array in accordance with permittivity.

A protrusion may be formed on a surface of the assistant installation structure, and the assistant installation structure may be fitted to the window by the protrusion.

Forceps may be formed on a surface of the assistant installation structure, and the assistant installation structure may be coupled to the window by the forceps.

A compression portion may be formed on a surface of the assistant installation structure, and the assistant installation structure may be coupled to the window by the compression portion.

A bonding portion may be formed on a surface of the assistant installation structure, and the assistant installation structure may be coupled to the window by the bonding portion.

A slide groove may be formed on a surface of the assistant installation structure, and the assistant installation structure may be coupled to the window by the slide groove.

The antenna array may be fixed by being coupled to the assistant installation structure through the antenna array seat.

The antenna array seat may be formed so that the antenna array can be detachably attached to the assistant installation structure.

Advantageous Effects of Invention

An antenna assembly according to various embodiments can provide a wide coverage and a high gain in radio wave transmission/reception.

MODE FOR THE INVENTION

Figure 1:
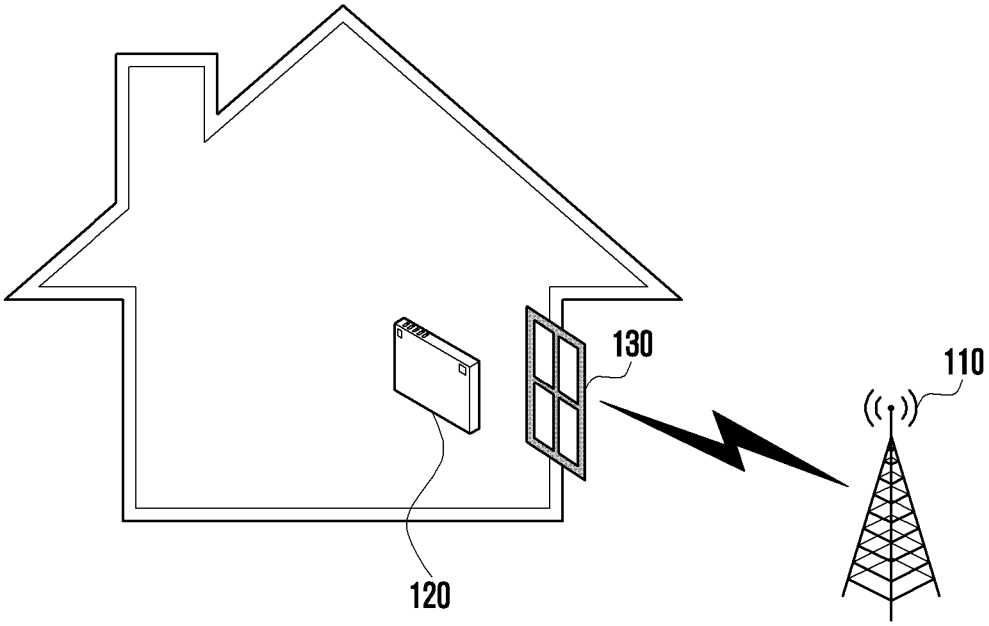
FIG. 1 is a view briefly showing a base station, a repeater including an antenna array, and a window.

In describing the exemplary embodiments of the disclosure, descriptions related to technical contents which are well-known in the art to which the disclosure pertains, and are not directly associated with the disclosure, will be omitted. Such an omission of unnecessary descriptions is intended to prevent obscuring of the main idea of the disclosure and more clearly transfer the main idea.

For the same reason, in the accompanying drawings, some elements may be exaggerated, omitted, or schematically illustrated. Further, the size of each element does not entirely reflect the actual size. In the drawings, identical or corresponding elements are provided with identical reference numerals.

The advantages and features of the disclosure and ways to achieve them will be apparent by making reference to embodiments as described below in detail in conjunction with the accompanying drawings. However, the disclosure is not limited to the embodiments set forth below, but may be implemented in various different forms. The following embodiments are provided only to completely disclose the disclosure and inform those skilled in the art of the scope of the disclosure, and the disclosure is defined only by the scope of the appended claims. Throughout the specification, the same or like reference numerals designate the same or like elements.

Here, it will be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart block or blocks. These computer program instructions may also be stored in a computer usable or computer-readable memory that can direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

And each block of the flowchart illustrations may represent a module, segment, or portion of code, which includes one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

As used herein, the "unit" refers to a software element or a hardware element, such as a Field Programmable Gate Array (FPGA) or an Application Specific Integrated Circuit (ASIC), which performs a predetermined function. However, the "unit does not always have a meaning limited to software or hardware. The "unit" may be constructed either to be stored in an addressable storage medium or to execute one or more processors. Therefore, the "unit" includes, for example, software elements, object-oriented software elements, class elements or task elements, processes, functions, properties, procedures, sub-routines, segments of a program code, drivers, firmware, micro-codes, circuits, data, database, data structures, tables, arrays, and parameters. The elements and functions provided by the "unit" may be either combined into a smaller number of elements, "unit" or divided into a larger number of elements, "unit". Moreover, the elements and "units" may be implemented to reproduce one or more CPUs within a device or a security multimedia card. Also, in an embodiment, the '~ unit' may include one or more processors.

As described above, an antenna assembly according to the disclosure may include an antenna array, a film layer, and a lens. The film layer and the lens are used to improve transmission performance of radio waves that are radiated through the antenna array or to improve reception performance of radio waves that are received through the antenna array.

Accordingly, in order to help understand the disclosure, the configuration and effect of the film layer and the lens of the antenna assembly will be described in more detail and, hereafter, the configuration of the film layer is described in detail first.

FIG. 1 is a view briefly showing a base station, a repeater including an antenna array, and a window;

A base station 110 outputs radio waves through an antenna and the radio waves output from the base station 110 can be transmitted to a repeater 120. On the contrary, as described above, the base station may receive radio waves output from the repeater 120, but it is exemplified that the base station 110 is a transmission part and the repeater 120 is a reception part in this specification.

The repeater 120, which is terminal equipment connected to a network, may be, for example, a modem, a set-top box, a terminal, etc. The repeater 120 (customer premises equipment) may be disposed indoor, and particularly, may be disposed around a window 130.

The wireless communication frequency band of the base station 110 and the repeater 120 may be a superhigh frequency (e.g., 28 GHz) band. As known in the art, when a high frequency band is used in a superhigh frequency band, there is an advantage in terms of transmission speed, but radio wave attenuation is unavoidably intense Accordingly, it is preferable to dispose the repeater 120 that performs communication with the base station 110 outside a building, in a communication system that uses superhigh frequency communication. However, when the repeater 120 is disposed outside a building, there is a high possibility that the repeater 120 is damaged by external factors (rain, snow, external shock, etc.).

Therefore, it is preferable to dispose the repeater 120 inside a building, and accordingly, it is considered to dispose the repeater 120 around the window 130 in a building, as described above. This is because radio wave attenuation due to the window 130 is less than radio wave attenuation due to the walls of a building.

Hereafter, various embodiments in which the repeater 120 can be disposed around the window 130 are provided. In more detail, the repeater 120 and the window 130 may be combined through an assistant installation device, and the assistant installation device and the window 130 may be combined in various ways.

Meanwhile, FIG. 1 is only an example of an actual use type of various embodiments of the disclosure, and the configuration and actual use types of the base station 110 and the repeater 120 are not limited thereto. That is, various embodiments of the disclosure may relate to a window product that can improve transmission of radio waves that are transmitted from an antenna of a first device (e.g., the base station 110) to an antenna of a second device (e.g., the repeater 120), or a film-layered product that is attached to a window, in which the kinds or actual use types of the first device and the second device are not limited.

Figure 2:
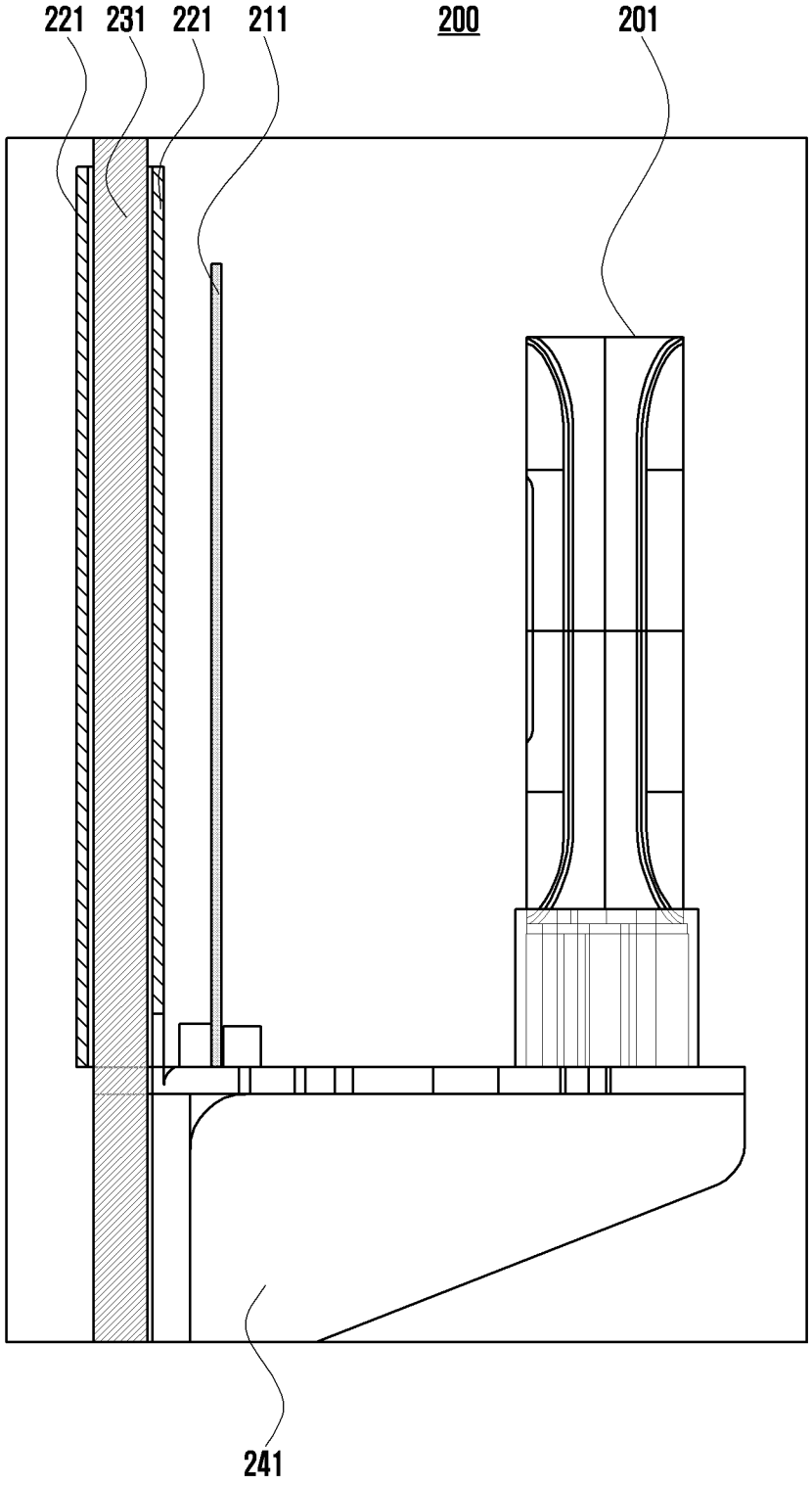
FIG. 2 is a view showing an embodiment of an antenna assembly according to the disclosure.

FIG. 2 is a view showing an embodiment of an antenna assembly according to the disclosure.

An antenna assembly 200 according to the disclosure may include: an antenna array 201 including at least one antenna; a film layer 221 made of at least one insulating substance, spaced a predetermined first distance apart from the antenna array, and bonded to a surface of a window 231; a lens 211 spaced a predetermined second distance from the antenna array and disposed between the antenna array and the film layer; and an assistant installation structure 241 having a first surface attached and fixed to the window and a second surface on which an antenna array seat and a lens seat are formed.

The lens 211 is not a necessary component in the antenna assembly 200 according to the disclosure. The lens may not be provided, depending on the characteristics of the antenna array 201 and the film layer 221. However, the lens 211 has an effect that improves a gain value of a beam, which is radiated through the antenna array 201, by changing the phase of the beam, so it may be preferable that the lens 211 is included in the antenna assembly 200, thereby improving the performance of the antenna assembly 200. A more detailed operation and configuration of the lens 211 will be described below.

Further, the permittivity of the insulating substance of the film layer 221 according to the disclosure may be lower than the permittivity of the window 231 and higher than the permittivity of air, thereby being able to reduce a loss of transmission of radio waves that travel into the window 231 and pass through the window 231.

The film layer 221, as shown in FIG. 2, may be disposed not only on the side of the window inside a building, but also the side of the window outside a building. That is, a film layer can be disposed on both of the inner side and the outer side of the window. A more detailed operation and configuration of the film layer 221 will be described below.

The assistant installation structure 241 according to the disclosure, as described above, may have seats to which the antenna array 201, the film layer 221, and the lens 211 can be seated, respectively. The assistant installation structure 241 may be formed in an integrated type that is fixed to the window 231 or a separated type that can be detachably coupled to the window 231.

Whether to couple the assistant installation structure to a window in an integrated type or a separated type may depend on the performance of the antenna assembly, the position of the window, the shape of the window, or the like. For example, when radio waves always travel to a fixed position in a window, it would be preferable to couple the antenna assembly to the window through an integrated-type assistant installation structure. However, when whether to couple the antenna assembly to a window is unclear and radio waves irregularly travel into the window, it may be preferable to couple the antenna assembly to the window through a separated-type assistant installation structure.

Accordingly, hereafter, an antenna assembly structure according to an embodiment is described in more detail separately in an integrated type and a separated type. Meanwhile, an antenna assembly structure is shown in FIG. 2 as an embodiment, so the scope of the disclosure should not be limited to the antenna assembly structure shown in FIG. 2.

Figure 3:
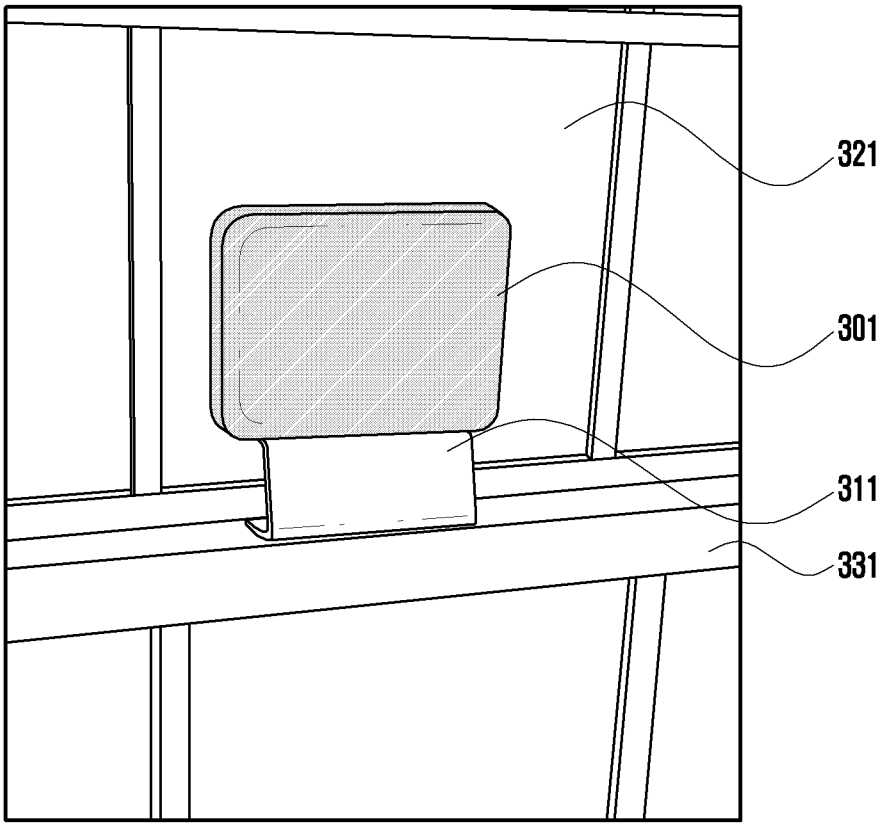
FIG. 3 is a view showing a first embodiment of an integrated-type antenna assembly structure.

FIG. 3 is a view showing a first embodiment of an integrated antenna assembly structure.

An antenna assembly 301 according to an embodiment may be attached and fixed to a sill 331 of a window 321. In more detail, the antenna assembly 301 according to the disclosure may include an assistant installation structure 331 coupled and fixed to the sill 331.

As described above, since the antenna assembly structure shown in FIG. 3 is an integrated-type antenna assembly structure, the assistant installation structure 331 may be integrated with the window sill 331 when the window sill 331 is formed.

That is, a user can use mobile communication through the window 321 by coupling only an antenna array and a lens to an antenna array seat and a lens seat of the assistant installation structure 311 formed on the window sill 331.

Figure 4:
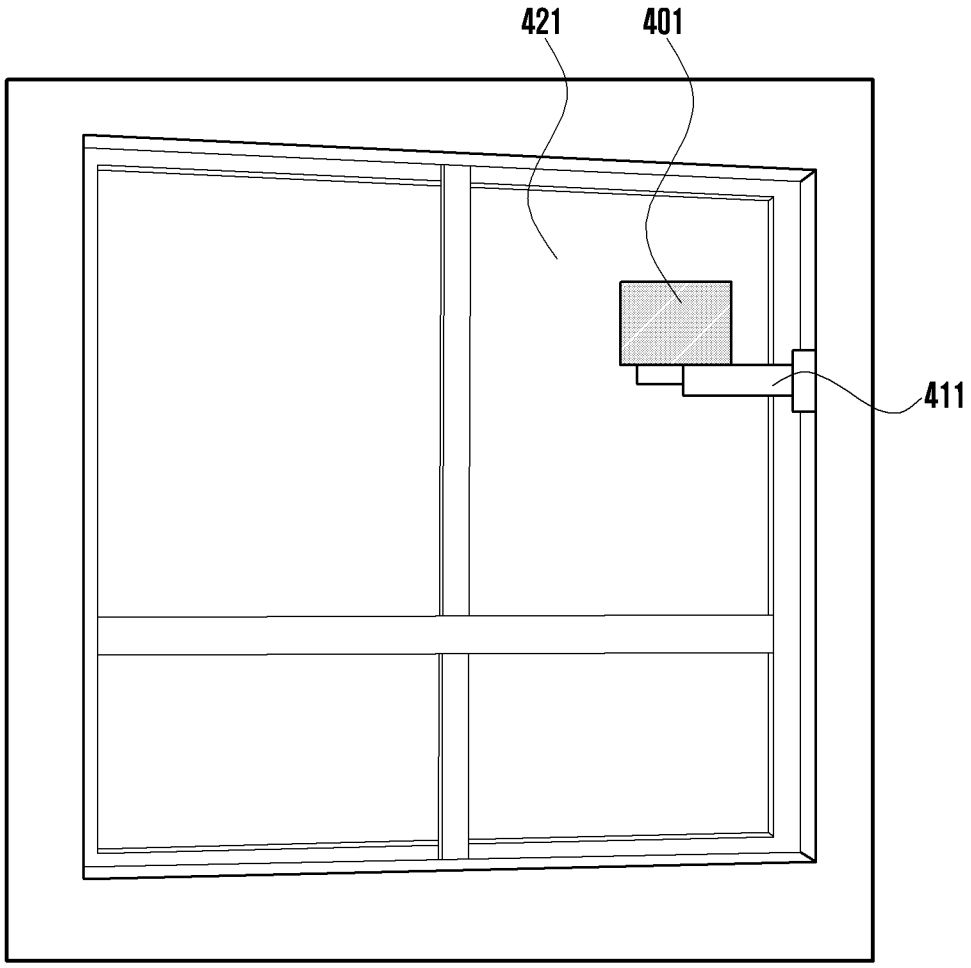
FIG. 4 is a view showing a second embodiment of an integrated-type antenna assembly structure.

FIG. 4 is a view showing second embodiment of an integrated antenna assembly structure.

An antenna assembly 401 according to an embodiment may be attached and fixed to the frame of a window 421. In more detail, the antenna assembly 401 according to the disclosure may include an assistant installation structure 411 coupled and fixed to the frame of the window 421.

As described above, since the antenna assembly structure shown in FIG. 4 is an integrated-type antenna assembly structure, the assistant installation structure 411 may be integrated with a window frame when the window frame is formed in a building.

That is, a user can use mobile communication through the window 421 by coupling only an antenna array and a lens to an antenna array seat and a lens seat of the assistant installation structure 411 formed at the window frame.

Although FIG. 4 shows only a structure in which an assistant installation structure is integrally formed on a side of a window frame, the scope of the disclosure should not be limited thereto and the assistant installation structure may be formed any positions over, under, at the left, and at the right of the window frame.

Further, other than the window sill or frame shown in FIGS. 3 and 4, it may be considered to couple an assistant installation structure directly to a window surface in an integrated type. In this case, an assistant installation structure may be made of a substance that can be integrated with a window by being fixed and coupled to the window.

That is, the disclosure provides an antenna assembly that includes a window and an assistant installation structure, which are formed in an integrated type, and that can communicate with an external communication system (a base station or a terminal) through the window using an antenna array coupled to the assistant installation structure.

The antenna array can also be detachably attached to the assistant installation structure, like the lens described above. In more detail, the assistant installation structure and the antenna array can be detachably coupled to each other in a fitting type (in which, since the antenna array can be attached and detached, there may be an advantageous effect in terms of maintenance of the antenna array).

Unlike the integrated-type antenna assembly structure described above, a window and an antenna assembly may be configured in a separated type. That is, a window and an antenna assembly may be combined through a separate configuration without an assistant installation structure integrally formed with a window to couple an antenna array.

In the separated-type antenna assembly structure, the arrangement of a film layer, a lens, and an antenna array is the same as that in the integrated-type antenna assembly. Accordingly, the description about the integrated-type antenna assembly structure is referred to for the description about the film layer, the lens, and the antenna array in the separated-type antenna assembly structure.

However, unlike that the assistant installation structure is integrally formed with a window in the integrated-type antenna assembly structure, an assistant installation structure is formed separately from a window in the separated-type antenna assembly structure. Accordingly, what type the assistant installation structure of a separated-type antenna assembly structure can be coupled to a window in is described hereafter.

Since an embodiment in which a separated-type antenna assembly structure can be coupled to a window is described hereafter, the scope of the disclosure should not be limited only to the following embodiment.

Figure 5:
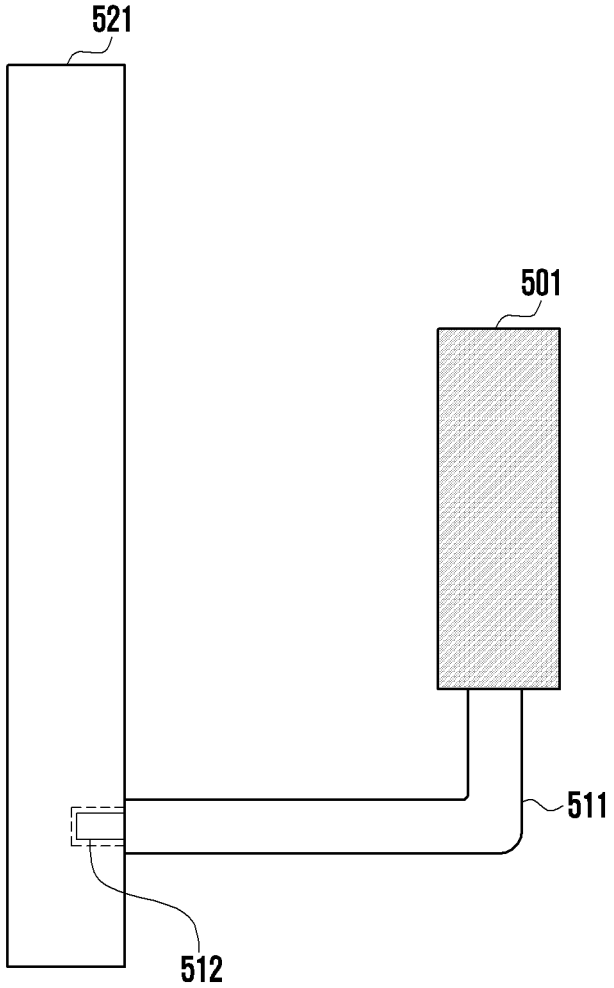
FIG. 5 is a view showing a first embodiment of a separated-type antenna assembly structure.

FIG. 5 is a view showing a first embodiment of a separated antenna assembly structure.

According to the first embodiment of a separated-type antenna assembly structure, a protrusion 512 may be formed on a surface of an assistant installation structure 511. For example, the protrusion 512 may be a screw with threads. A groove may be formed at a window 521 at a position corresponding to the protrusion of the assistant installation structure. For example, threads corresponding to the threads of the protrusion may be formed in the groove.

Accordingly, it is possible to couple an antenna assembly 501 to the window 521 by thread-fastening the screw to the groove. According to the first embodiment, a groove for fitting has to be formed at the window 521. Accordingly, the material of the portion that is fitted may have high strength such as the frame or sill of a window.

Although the protrusion 512 is formed at the assistant installation structure 511 and a groove is formed at the window in FIG. 5, a protrusion may be formed at the window 521 and a groove may be formed at the assistant installation structure 511. That is, the scope of the disclosure should not be limited to the structure shown in FIG. 5.

Figure 6:
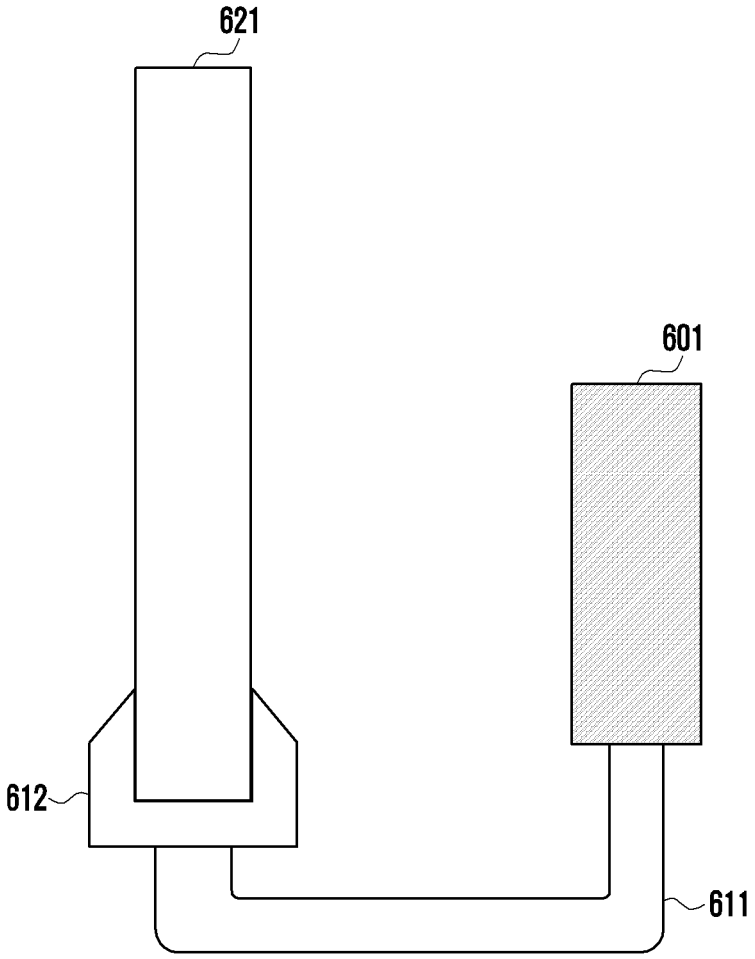
FIG. 6 is a view showing a second embodiment of a separated-type antenna assembly structure.

FIG. 6 is a view showing a second embodiment of a separated-type antenna assembly structure.

According to the second embodiment of a separated-type antenna assembly structure, forceps 612 may be formed on a surface of an assistant installation structure 611. For example, the assistant installation structure 611 can hold the frame or the sill of a window 621 using the forceps 612, whereby an antenna assembly 601 can be coupled and fixed to the window 621.

The second embodiment may be combined with the first embodiment described above. That is, a protrusion may be formed at the forceps formed at the assistant installation structure, and an antenna assembly and a window may be more firmly coupled by the protrusion (a third embodiment and a fifth embodiment to be described below may also be combined).

Figure 7:
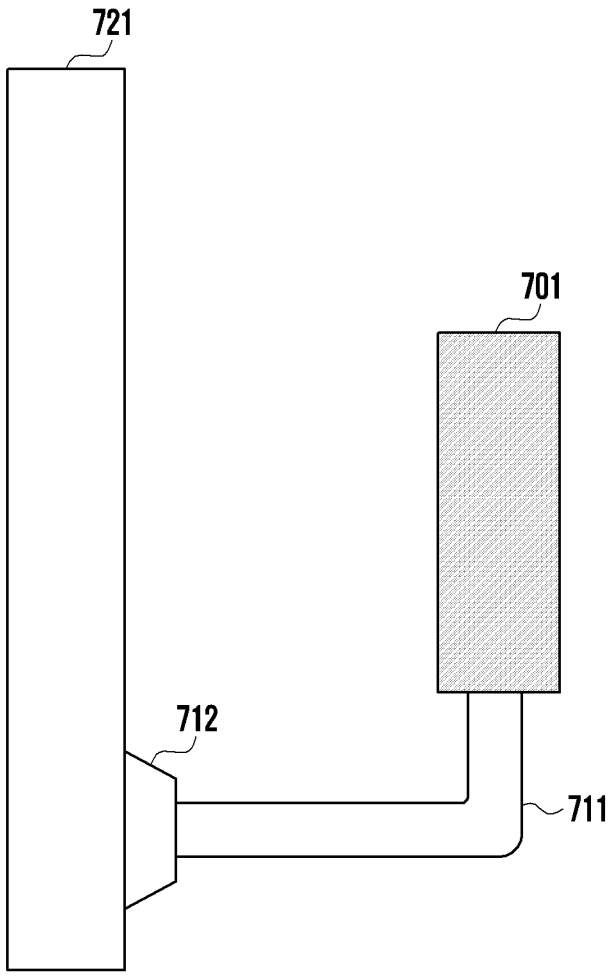
FIG. 7 is a view showing a third embodiment of a separated-type antenna assembly structure.

FIG. 7 is a view showing a third embodiment of a separated-type antenna assembly structure.

According to the third embodiment of a separated-type antenna assembly structure, a compression portion 712 may be formed on a surface of an assistant installation structure 711. For example, a plurality of compression portions 712 may be formed with predetermined gaps on a surface of the assistant installation structure, and the antenna assembly 701 and the window 721 can be coupled and fixed by the plurality of compression portions 712.

According to the third embodiment, unlike the first embodiment or the second embodiment, there is an advantage that the antenna assembly can be directly coupled to a glass surface rather than a window sill or a window frame. Further, the antenna assembly can be simply installed in comparison to the first embodiment or the second embodiment.

Figure 8:
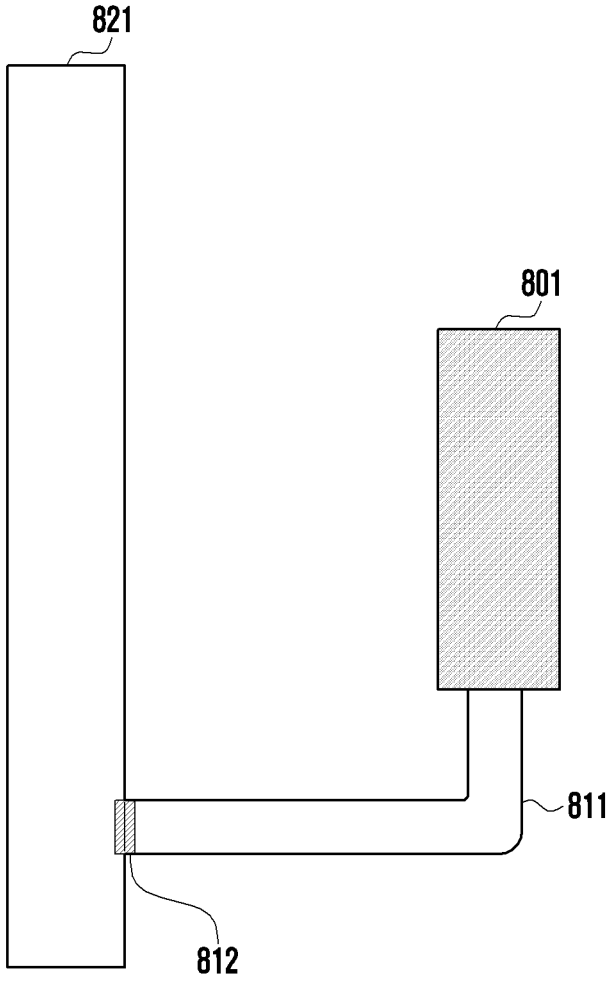
FIG. 8 is a view showing a fourth embodiment of a separated-type antenna assembly structure.

FIG. 8 is a view showing a fourth embodiment of a separated-type antenna assembly structure.

According to the fourth embodiment of a separated-type antenna assembly structure, a bonding portion 812 may be formed on a surface of an assistant installation structure 811. For example, a plurality of bonding portions 812 may be formed with predetermined gaps on a surface of the assistant installation structure, and an antenna assembly 801 and a window 821 can be coupled and fixed by the plurality of bonding portions 812.

The fourth embodiment also has an advantage that the antenna assembly can be directly coupled to a glass surface in the same way as the third embodiment. In addition, the fourth embodiment has an advantage that the antenna assembly can be most simply installed in comparison to other embodiments.

Figure 9:
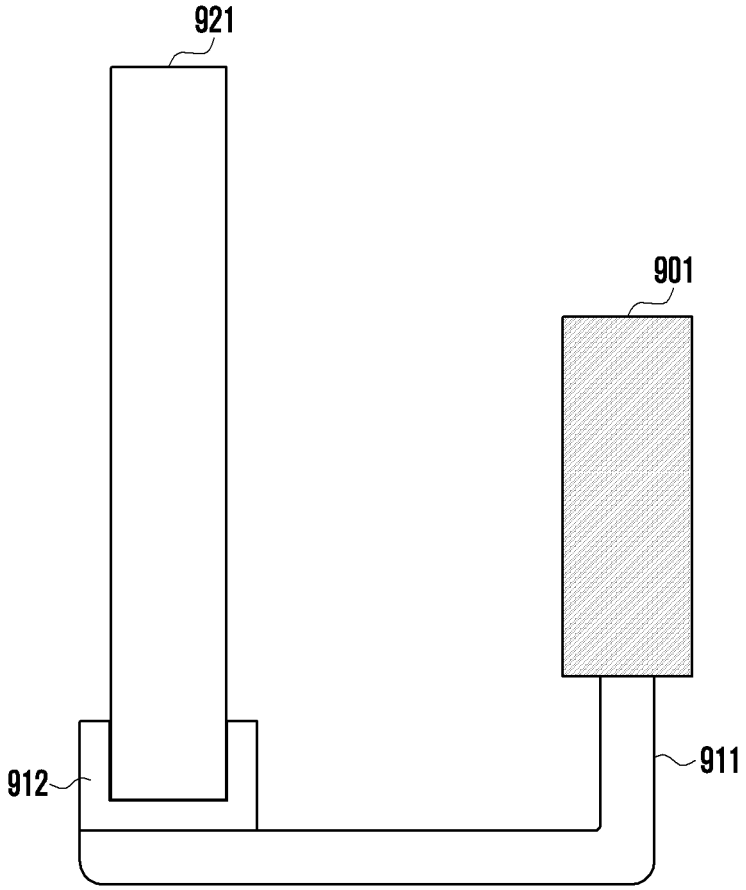
FIG. 9 is a view showing a fifth embodiment of a separated-type antenna assembly structure.

FIG. 9 is a view showing a fifth embodiment of a separated antenna assembly structure.

According to the fifth embodiment of a separated-type antenna assembly structure, a side groove 912 may be formed on a surface of an assistant installation structure 911. For example, a slide protrusion corresponding to the slide groove may be formed at a window sill or a window frame, and the assistant installation structure 911 may be coupled to the slide protrusion by sliding. That is, an antenna assembly 901 and a window 921 can be coupled and fixed by the slide groove 912.

Figure 10A:
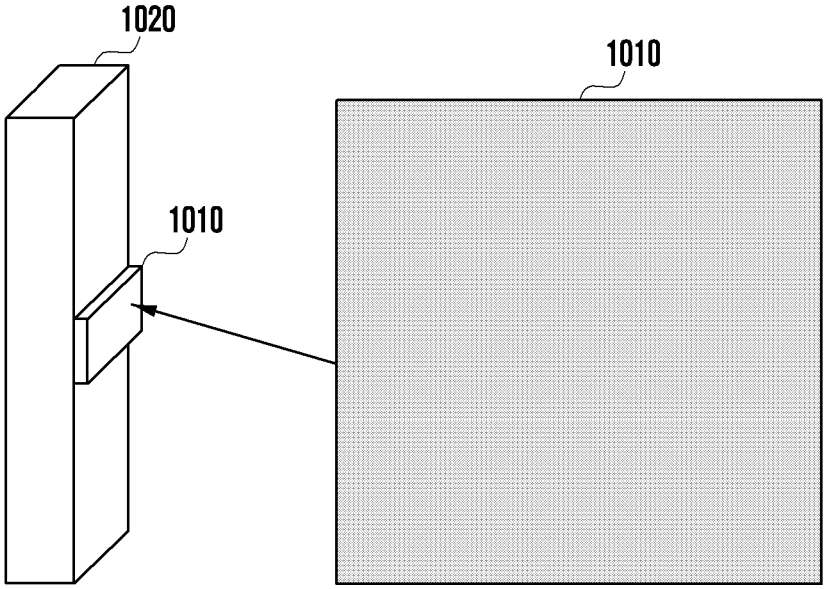
FIGS. 10A and 10B are views showing a window according to an embodiment and a film layer attached to the window.
Figure 10B:
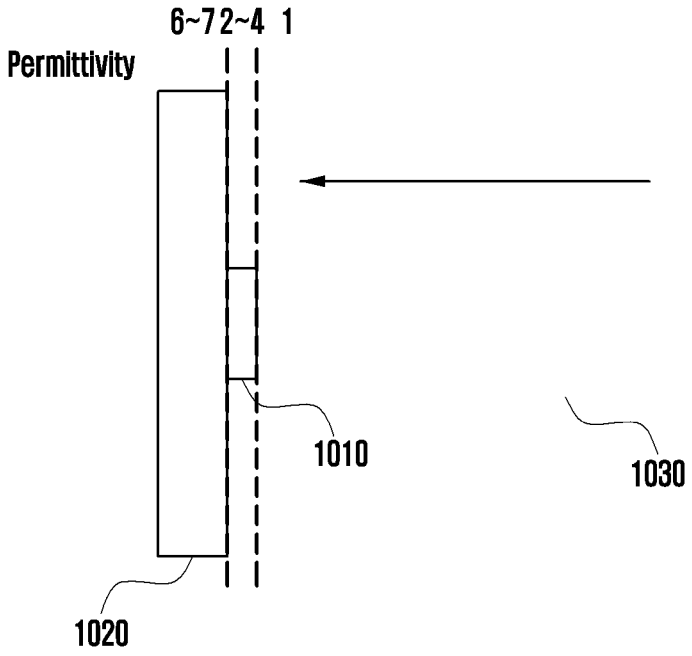

FIGS. 10A and 10B are views showing a window according to an embodiment and a film layer attached to the window.

In the first embodiment of the disclosure, a film layer 1010 made of an insulating substance is attached to a window 1020 made of a common glass material to reduce reflection of radio waves passing through the window from the outside.

According to this embodiment, the film layer 1010 is made of at least one insulating substance and may be bonded to a surface of the window 1020. The film layer 1010 is provided to reduce a loss of transmission of radio waves through the window 1020 when it is attached to the window 1020.

According to this embodiment, the window 1020 may be common glass not containing metallic substances. As known in the art, the permittivity of a window made of glass may be about 6 to 7 F/m and the permittivity of air may be about 1 F/m. The difference in permittivity increases the reflection ratio of radio waves output from a base station and then passing through the window 1020, which may be a factor that interferes with radio wave reception by a repeater disposed indoor.

Accordingly, the permittivity of the film layer 1010 may be lower than the permittivity of the window 1020 and higher than the permittivity of air 1030 to reduce the reflection ratio due to the difference in permittivity between the air 1030 and the window 1020. For example, the permittivity of the film layer 1010 may be 2 to 4 F/m.

According to an embodiment, the film layer 1010 may be composed of a plurality of film layers, which may have different permittivity. In this case, the permittivity of the film layers may be lower than the permittivity of the window 1020 and higher than the permittivity of the air 1030, and they may be attached closer to the window in higher order of permittivity.

According to an embodiment, the thickness of the film layer 1010 may be determined such that the entire thickness is proportioned to the wavelength of radio waves when the film layer 1010 is attached to the window 1020, and may be determined in consideration of the thickness of the window 1020 and the frequency thickness of radio waves.

Figure 11A:
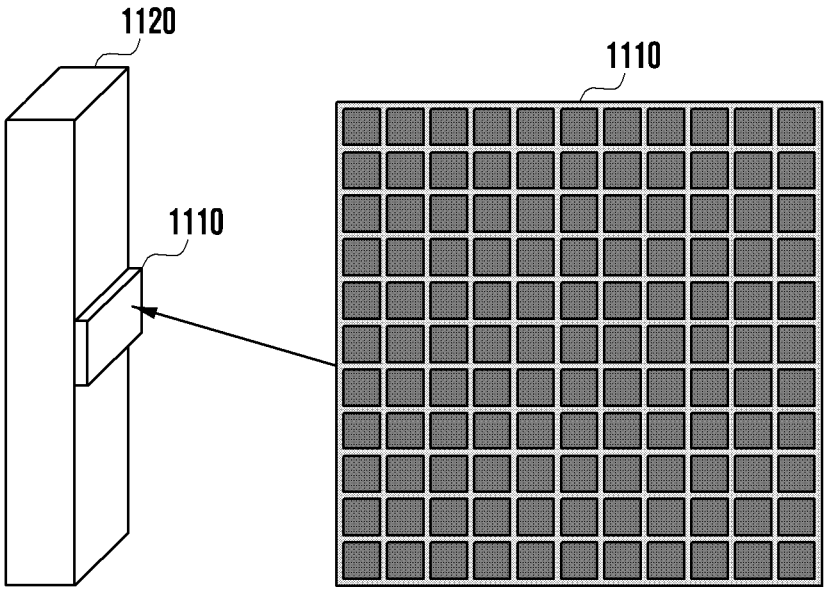
FIGS. 11A and 11B are views showing a window according to an embodiment and a film layer attached to the window.
Figure 11B:
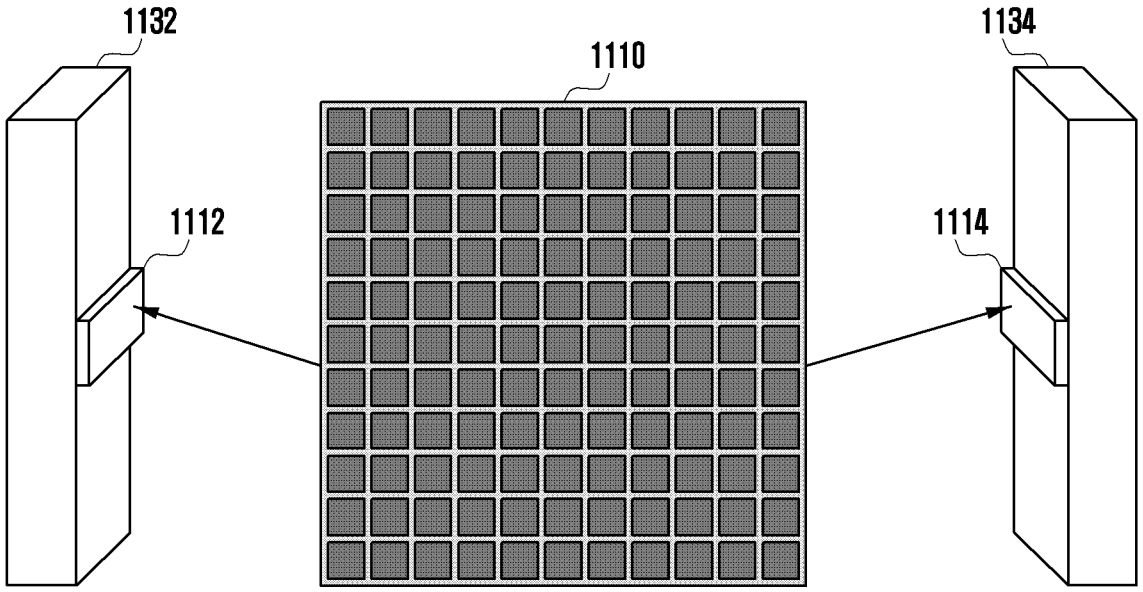

FIGS. 11A and 11B are views showing a window according to an embodiment and a film layer attached to the window.

A film layer 1110 may include an insulating layer and an electrode layer. The size of the film layer 1110 is not limited, but may be the size or more of an area through which radio waves can pass when radio waves reach a repeater through a window 1120 from the outside, in consideration of at least the distance from the repeater. As shown in FIG. 11A, a surface of an insulating layer may be attached to the window 1120 through an adhesive.

A loss of radio waves may be generated by reflection in glass due to physical characteristics and the radio wave loss value can be reduced by attaching the film layer 1110.

According to various embodiments, a multi-layer window 1132 and 1134 may be used, and a plurality of film layers 1112 and 1114 may be attached respectively to windows 1132 and 1134 of the multi-layer window 1132 and 1134. The electrode patterns of film layers 1112 and 1114 that are attached to windows 1120, respectively, may be the same.

The glass of the multi-layer window 1132 and 1134 has high permittivity, so reflection occurs, and destructive interference may occur due to a signal re-reflected from the inside of the multi-layer window 1132 and 1134. Further, when the antenna of a repeater is positioned close to the windows 1132 and 1134, performance may be deteriorated by reflective waves. According to various embodiments, when the film layers 1112 and 1114 are attached the windows 1132 and 1134, respectively, the reasons exemplified above are reduced, so a loss of radio waves can be decreased.

Figure 12:
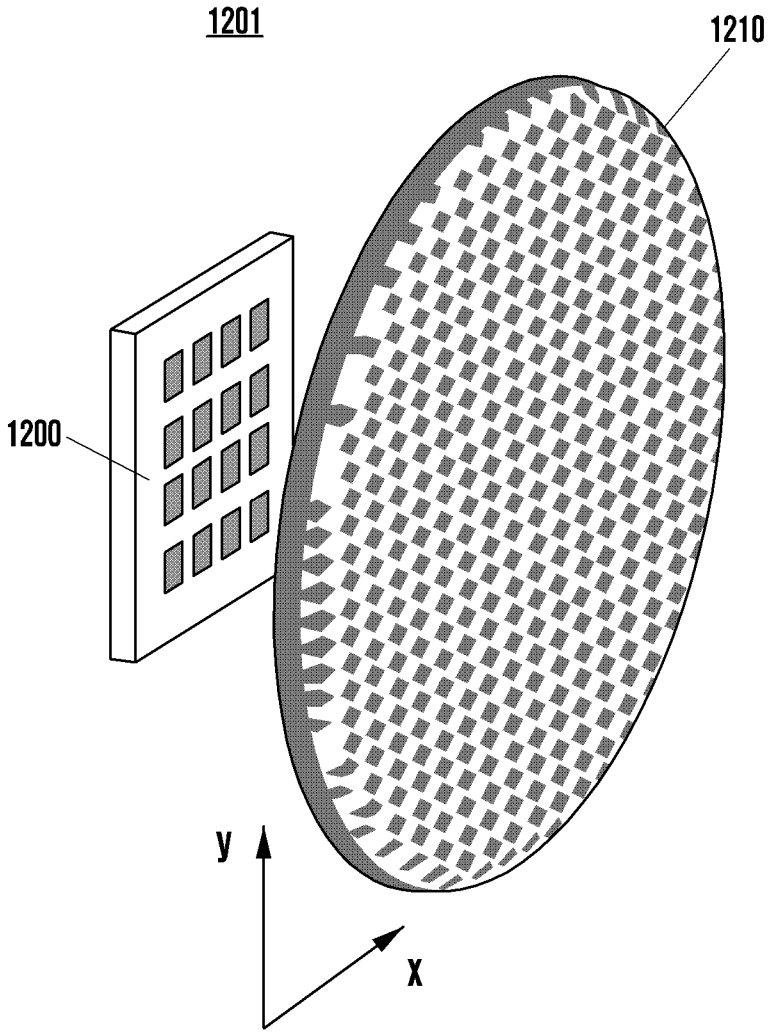
FIG. 12 is a view showing an antenna assembly according to various embodiments.

FIG. 12 is a view showing an antenna assembly 1201 according to various embodiments.

The antenna assembly 1201 according to various embodiments may include an antenna array 1200 and a lens 1210. The lens 1210 includes a plurality of unit cells and the unit cells can change the index of refraction of radio waves in accordance with inherent permittivity. The lens 1210 can correct a phase by refracting radio waves radiated from the antenna array 1200.

In the lens 1210 according to various embodiments, unit cells having the same permittivity are arranged in an x-axial direction and unit cells having different permittivity are arranged in a y-axial direction, whereby when radio waves radiated from the antenna array 1200 travel in the x-axial direction, the radio waves have the same phase as that of radio waves traveling into the lens 1210, thereby being able to amplify the coverage of the output radio waves.

The unit cells according to various embodiments may have a 3-dimensional shape having unit area and height. The unit cells have the same unit area, but the permittivity of the unit cells may be changed by the material or height of dielectrics of the unit cells. For example, when unit cells have dielectrics having the same unit area and material, the permittivity may depend on the height of the unit cells.

When the unit cells included in the lens 1210 are same in unit area and height, the permittivity of the unit cells may depend on the material of the unit cells. When unit cells having the same unit area and height are disposed in the lens 1210 in both of the x-axial direction and the y-axial direction, in the lens 1210 according to various embodiments, unit cells having the same permittivity because the materials of the dielectrics are the same are disposed in the x-axial direction and unit cells having different permittivity because the materials of the dielectrics are different are disposed in the y-axial direction, whereby radio waves radiated from the antenna array 1200 have the same phase as radio waves traveling into the lens 1210 when traveling in the x-axial direction, thereby being able to amplify the coverage of the output radio waves.

Since permittivity may be depend on the heights of unit cells having the same unit area and the same material of dielectrics, unit cells having the same height are arranged in an x-axial direction and unit cells having different heights are arranged in a y-axial direction in the lens 1210, whereby when radio waves radiated from the antenna array 1200 travel in the x-axial direction, the radio waves have the same phase as that of radio waves traveling into the lens 1210, thereby being able to amplify the coverage of the output radio waves.

For example, when the material of the dielectric and the unit areas of the unit cells of the lens 1210 are the same, it is possible to change the permittivity by changing the heights. The unit cells forming a pattern may have the same height and height differences may be generated in unit cells of different patterns.

Unit cells are not disposed in the lens 1210 according to various embodiments and a metal pattern is formed on the lens 1210, whereby it is possible to change the phase of radio waves that are radiated from the antenna array 1200.

Figure 13:
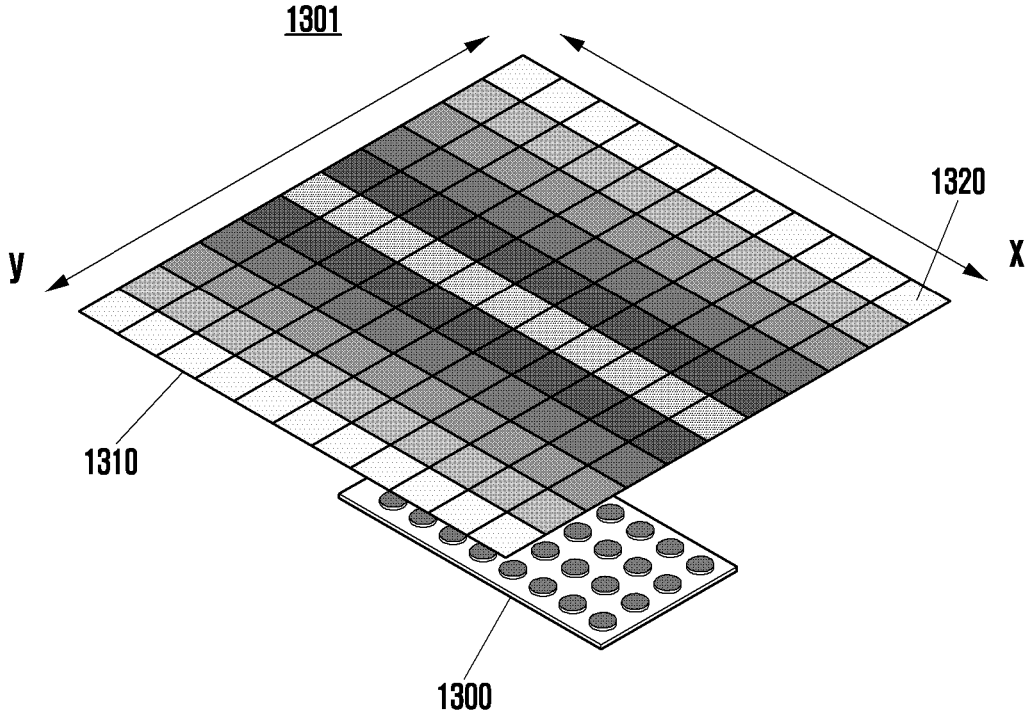
FIG. 13 is a view showing an antenna assembly according to various embodiments.

FIG. 13 is a view showing an antenna assembly 1301 according to various embodiments.

An antenna assembly 1301 according to various embodiments may include an antenna array 1300 and a lens 1320. The lens 1320 may include a plurality of unit cells 1320.

In the lens 1310 according to various embodiments, unit cells 1320 having the same permittivity are disposed in an x-axial direction and unit cells having different permittivity are disposed in a y-axial direction, whereby radio waves radiated from the antenna array 1300 have the same phase as those of radio waves traveling out of the lens 1310 and radio waves traveling into the lens 1310 when traveling in the x-axial direction of the lens 1310, thereby being able to amplify the coverage of output radio waves. Further, when the radio waves radiated from the antenna array 1300 travel in the y-axial direction of the lens 1310, the radio waves traveling out of the lens 1310 all have the same phase, thereby being able to increase the gain of output radio waves.

Unit cells 1320 having the same permittivity are disposed in the x-axial direction and unit cells having different permittivity are disposed in the y-axial direction in the lent 1310 according to various embodiments, whereby the unit cells 1320 having the same permittivity and disposed in the x-axial direction may have a linear pattern having a straight line or an open curve.

Unit cells are not disposed in the lens 1310 according to various embodiments and a metal pattern is formed on the lens 1310, whereby it is possible to change the phase of radio waves that are radiated from the antenna array 1300. The metal pattern on the lens 1310 may have a linear pattern having a straight line or an open curve in the x-axial direction.

The unit cells 1320 according to various embodiments may have a 3-dimensional shape having unit area and height. The unit cells 1320 have the same unit area, but the permittivity of the unit cells may be changed by the material or height of dielectrics of the unit cells. For example, when the unit cells 1320 have the same unit area and material, the permittivity may depend on the heights of the unit cells 1320.

When the unit cells 1320 included in the lens 1310 are same in unit area and height, the permittivity of the unit cells 1320 may depend on the material. When unit cells 1320 having the same unit area and height are disposed in the lens 1310 in both of the x-axial direction and the y-axial direction, in the lens 1310 according to various embodiments, unit cells 1320 having the same permittivity because the materials of the dielectrics are the same are disposed in the x-axial direction and unit cells 1320 having different permittivity because the materials of the dielectrics are different are disposed in the y-axial direction, whereby radio waves radiated from the antenna array 1300 have the same phase as radio waves traveling into the lens 1310 when traveling in the x-axial direction, thereby being able to amplify the coverage of the output radio waves.

When the unit cells 1320 in the lens 1310 have the same unit area and the same material of dielectrics, since permittivity may be depend on the heights of unit cells 1320, unit cells 1320 having the same height are arranged in an x-axial direction and unit cells 1320 having different heights are arranged in a y-axial direction in the lens 1310, whereby when radio waves radiated from the antenna array 1300 travel in the x-axial direction have the same phase as that of radio waves traveling into the lens 1310, thereby being able to amplify the coverage of the output radio waves.

For example, when the material of the dielectric and the unit areas of the unit cells 1320 of the lens 1310 are the same, it is possible to change the permittivity by changing the heights. The unit cells 1320 forming a pattern may have the same height and height differences may be generated in unit cells 1320 of different patterns.

Unit cells are not disposed in the lens 1310 according to various embodiments and a metal pattern is formed on the lens 1310, whereby it is possible to change the phase of radio waves that are radiated from the antenna array 1300. The metal pattern on the lens 1310 may have a linear pattern having a straight line or an open curve in the x-axial direction.

Meanwhile, the embodiments of the disclosure disclosed in the specification and the drawings have been presented to easily explain technical contents of the disclosure and help comprehension of the disclosure, and do not limit the scope of the disclosure. That is, it is obvious to those skilled in the art to which the disclosure belongs that different modifications can be achieved based on the technical spirit of the disclosure. Further, if necessary, the above respective embodiments may be employed in combination. For example, parts of embodiment 1, embodiment 2, and embodiment 3 of the disclosure are combined so as to employ a base station and a terminal. In addition, the above embodiments are presented based on an LTE system, but other modifications based on the technical spirit of the embodiment can be implemented in other systems such as a 5G or NR system or the like.

The invention claimed is:

1. An antenna assembly comprising:

an antenna array including at least one antenna;

a film layer made of at least one insulating substance, the film layer being spaced a predetermined first distance apart from the antenna array and including a first film bonded to a first surface of a window and a second film bonded to a second surface of the window; and an assistant installation structure having a first surface, which is attached and fixed to the first surface of the window, and a second surface on which an antenna array seat is formed, wherein a permittivity of the at least one insulating substance of the film layer is lower than a permittivity of the window and higher than a permittivity of air.

2. The antenna assembly of claim 1, further comprising:

a lens spaced a predetermined second distance from the antenna array and disposed between the antenna array and the film layer, wherein a lens seat for locating the lens is formed on the second surface of the assistant installation structure.

3. The antenna assembly of claim 2, wherein the lens is composed of a plurality of unit cells, and wherein the plurality of unit cells correct a phase of radio waves radiated from the antenna array in accordance with permittivity.

4. The antenna assembly of claim 1, wherein the film layer reduces a loss of transmission of radio waves through the window when the film layer is attached to the window.

5. The antenna assembly of claim 1, wherein the assistant installation structure is attached and fixed to a sill of the window.

6. The antenna assembly of claim 1, wherein the assistant installation structure is attached and fixed to a window frame of the window.

7. The antenna assembly of claim 1, wherein the antenna array is fixed by being coupled to the assistant installation structure through the antenna array seat.

8. The antenna assembly of claim 1, wherein the antenna array seat is formed so that the antenna array can be detachably attached to the assistant installation structure.

9. An antenna assembly comprising:

an antenna array including at least one antenna;

a film layer made of at least one insulating substance, the film layer being spaced a predetermined first distance apart from the antenna array and including a first film bonded to a first surface of a window and a second film bonded to a second surface of the window; and an assistant installation structure having a first surface, which is coupled to the window, and a second surface on which an antenna array seat is formed, wherein a permittivity of the at least one insulating substance of the film layer is lower than a permittivity of the window and higher than a permittivity of air.

10. The antenna assembly of claim 9, further comprising:

a lens spaced a predetermined second distance from the antenna array and disposed between the antenna array and the film layer, wherein a lens seat for locating the lens is formed on the second surface of the assistant installation structure.

11. The antenna assembly of claim 10, wherein the lens is composed of a plurality of unit cells, and wherein the plurality of unit cells correct a phase of radio waves radiated from the antenna array in accordance with permittivity.

12. The antenna assembly of claim 9, wherein a protrusion is formed on a surface of the assistant installation structure, and wherein the assistant installation structure is fitted to the window by the protrusion.

13. The antenna assembly of claim 9, wherein forceps are formed on a surface of the assistant installation structure, and wherein the assistant installation structure is coupled to the window by the forceps.

14. The antenna assembly of claim 9, wherein a compression portion is formed on a surface of the assistant installation structure, and wherein the assistant installation structure is coupled to the window by the compression portion.

15. The antenna assembly of claim 9, wherein a bonding portion is formed on a surface of the assistant installation structure, and wherein the assistant installation structure is coupled to the window by the bonding portion.

16. The antenna assembly of claim 9, wherein the assistant installation structure is at least one of fixedly coupled to a glass surface of the window or detachably coupled to the glass surface of the window.

17. The antenna assembly of claim 1, wherein the first film includes a plurality of film layers having different permittivity, the plurality of film layers being attached closer to the first surface of the window in higher order of permittivity.

18. The antenna assembly of claim 1, wherein the second film includes a plurality of film layers having different permittivity, the plurality of film layers being attached closer to the second surface of the window in higher order of permittivity.

19. The antenna assembly of claim 1, wherein a thickness of the film layer is determined based on a thickness of the window and a wavelength of radio waves using by the at least one antenna.

20. The antenna assembly of claim 19, wherein a thickness of the film layer is determined such that an entire thickness of the film layer and the window is proportioned to the wavelength of radio waves.

* * * * *